US006983860B2

(12) United States Patent
Arnaboldi

(10) Patent No.: US 6,983,860 B2
(45) Date of Patent: Jan. 10, 2006

(54) SPREADING HEAD, PARTICULARLY FOR THERMOPLASTIC MATERIAL

(75) Inventor: Riccardo Arnaboldi, Spresiano (IT)

(73) Assignee: H.I.P. S.R.L. High Industrial Performances, Spresiano (IT)

( * ) Notice: Subject to any disclaimer, the term of this patent is extended or adjusted under 35 U.S.C. 154(b) by 241 days.

(21) Appl. No.: 10/250,747

(22) PCT Filed: Jan. 10, 2002

(86) PCT No.: PCT/EP02/00170

§ 371 (c)(1),
(2), (4) Date: Jul. 7, 2003

(87) PCT Pub. No.: WO02/057025

PCT Pub. Date: Jul. 25, 2002

(65) Prior Publication Data

US 2004/0065756 A1 Apr. 8, 2004

(30) Foreign Application Priority Data

Jan. 17, 2001 (IT) ..... TV2001A0008

(51) Int. Cl.
*B05B 9/00* (2006.01)

(52) U.S. Cl. ..... 222/55; 222/146.2

(58) Field of Classification Search ..... 222/52, 222/55, 146.2, 146.5; 239/533.1, 569, 583; 137/554

See application file for complete search history.

(56) References Cited

U.S. PATENT DOCUMENTS

| | | | | |
|---|---|---|---|---|
| 4,662,540 | A * | 5/1987 | Schroter | 222/55 |
| 4,678,100 | A * | 7/1987 | Gelinas et al. | 222/52 |
| 4,842,162 | A | 6/1989 | Merkel | |
| 4,907,741 | A * | 3/1990 | McIntyre | 239/124 |
| 4,922,852 | A * | 5/1990 | Price | 222/55 |
| 4,987,854 | A * | 1/1991 | Hall | 239/296 |
| 5,312,016 | A * | 5/1994 | Brennan et al. | 222/55 |
| 5,782,410 | A | 7/1998 | Weston | |
| 6,060,125 | A * | 5/2000 | Fujii | 427/8 |

FOREIGN PATENT DOCUMENTS

| | | |
|---|---|---|
| EP | 0 850 694 | 7/1998 |

* cited by examiner

*Primary Examiner*—Eric Keasel
(74) *Attorney, Agent, or Firm*—Albert Josif; Daniel O'Byrne

(57) ABSTRACT

A thermoplastic material spreading head including: a valve having a movable needle and a needle cup; a first duct for feeding fluid thermoplastic material to the valve; a second duct, connected in fluid communication to cup; the needle being movable in the body between an open position allowing passage of thermoplastic material flow from the first duct to the second duct, and a closed position in which the needle interferes with the cup to arrest the thermoplastic material flow; an actuating and detecting intake for selective positioning of the needle, for injection in the intake of a pressurized actuation fluid adapted to move the needle at least to the open position; and a pressure sensor arranged on the intake to sense the pressure of the pressurized actuation fluid and provide a confirmation of the position of the needle at least in the open condition.

16 Claims, 3 Drawing Sheets

SPREADING HEAD, PARTICULARLY FOR THERMOPLASTIC MATERIAL

BACKGROUND OF THE INVENTION

The present invention relates to a spreading head, particularly for spreading thermoplastic material on an intermediate component.

Known spreading heads are currently used which are usually arranged transversely to the direction of movement of the intermediate component.

Such heads are usually composed of a laminar-flow assembly having a beak-shaped cross-section, an upper clamp block, and an underlying lower clamp block.

As an alternative, above the lower clamp block there can be a single device that acts as laminar-flow assembly and as upper clamp block.

The thermoplastic material (for example adhesives, including those known as "hot melt" or "reactive hot melt" adhesives) is first melted by means of a suitable continuous melting unit (tank) or a drum unloader and is then injected into the spreading head by means of gear pumps.

The transverse distribution of the adhesive is performed by means of a closed duct affected by uniformly spaced valves (modules), which allow the adhesive to reach a second laminar-flow region through channels and optionally a third region.

Such channels convey the adhesive directly to the laminar-flow assembly, which is directly connected to the intermediate component.

As mentioned, the passage of the fluid adhesive is allowed by suitable valves, usually known as modules, which are mostly actuated by electric valves of the pneumatic or magnetic type.

The duct is closed downstream of each valve by means of a device of the needle type, which closes onto an appropriately provided cup.

The ducts are opened by lifting the needle from the closed position.

The main drawback of this known head is the fact that sometimes the opening movement of the valve is not achieved; this can depend on various situations, including the fact that the injected hot-melt adhesives can be unstable and, if they remain at high temperature, can trigger charring (cracking) phenomena that block the valve.

Furthermore, if reactive hot-melts are used, the adhesive can polymerize in the head itself, consequently blocking the valve.

The opening movement of the valve might not be achieved also due to normal mechanical problems (hindered sliding movements) or due to wear or failure of sealing gaskets (O-rings) of the pneumatic circuit.

Clearly, the uncontrolled failure of a valve to open entails a severe damage for the application of the adhesive and entails, in the case of spreading heads of the known type, a reduction in the overall amount of adhesive applied to the substrate.

The effect in heads of the so-called "step" type (which comprise multiple regions for releasing the material in film form) is much more severe: such heads are choked transversely and each individual valve supplies a step without thereby any possibility to compensate for the adhesive that does not arrive from the unintentionally "closed" valve; the occurrence of this condition entails the uncontrolled production of rejects, since a band as wide as the step of adhesive will be missing on the strip being processed.

In addition to this, in many cases visual monitoring of the application is not possible owing to the small amount of adhesive that is applied: by way of example, the following application is cited:

thickness of applied adhesive: 1.5 microns
characteristics of adhesive: transparent
width of substrate: 3,600 mm
speed of application: 400 m/min In a correlated way, one can deduce that in the above cited application case the reject produced inadvertently might reach approximately 86,400 square meters/hour.

Moreover, one should consider that the product on which the hot melt is spread is normally coupled immediately by calendering to another film (immediately in order to utilize the ability of the hot melt to act as a bonding agent when it is at high temperature).

This entails the following further remarks: first of all, it is very difficult to perform visual inspection after spreading, since the region is located 300–400 mm from the calendering point (a distance that is covered in 0.0525 s in the above cited operating conditions).

Furthermore, it is extremely difficult to perform inspection, since the region to be examined is normally protected by barriers according to EC standards; finally, the defect (lack of adhesive on a band) is difficult to detect on the coupled material, which is wound immediately in a roll.

Currently, it is known, as a control measure that is usually adopted, to perform a sample check of the production, analyzing a transverse strip taken from the composite during production.

It is noted that this operation can occur easily only on the end portions of the rolls obtained once they have been removed from the machine; otherwise, the removal of samples would entail an inevitable machine downtime (complete cutting of the strip being processed and subsequent splicing).

Besides, identifying a band of defective product says nothing regarding the starting point and end point of the defect: one should bear in mind that since one is speaking of coupled products it is quite difficult to identify the head and the tail of the reject.

Clearly, there is the risk of not identifying a reject despite the sample check.

SUMMARY OF THE INVENTION

The aim of the present invention is therefore to solve the noted technical problems, eliminating the drawbacks of the cited known art and thus providing an invention that allows to obtain a head that allows to monitor the actual open condition of the valves (modules).

Within this aim, an object of the present invention is to provide a spreading head in which it is possible to detect the position of the needle in the valve, preferably detecting that it is in the open position.

Another important object is to provide a spreading head in which it is possible to detect immediately any failure to apply adhesive on a band.

Another object is to provide a spreading head that is structurally simple and has low manufacturing costs.

This aim and these and other objects that will become better apparent hereinafter are achieved by a spreading head, particularly for spreading thermoplastic material on an intermediate component, comprising a first duct for feeding an adhesive to a valve provided with a needle that interferes with a cup connected to a second duct for spreading said adhesive, characterized in that said valve comprises means suitable to actuate and/or visualize a selective positioning of said needle.

Advantageously, such means actuate the positioning of the needle in the open condition.

BRIEF DESCRIPTION OF THE DRAWINGS

Further characteristics and advantages of the invention will become better apparent from the detailed description of a particular embodiment, illustrated only by way of non-limitative example in the accompanying drawings, wherein.

DESCRIPTION OF THE PREFERRED EMBODIMENTS

Figure 2:
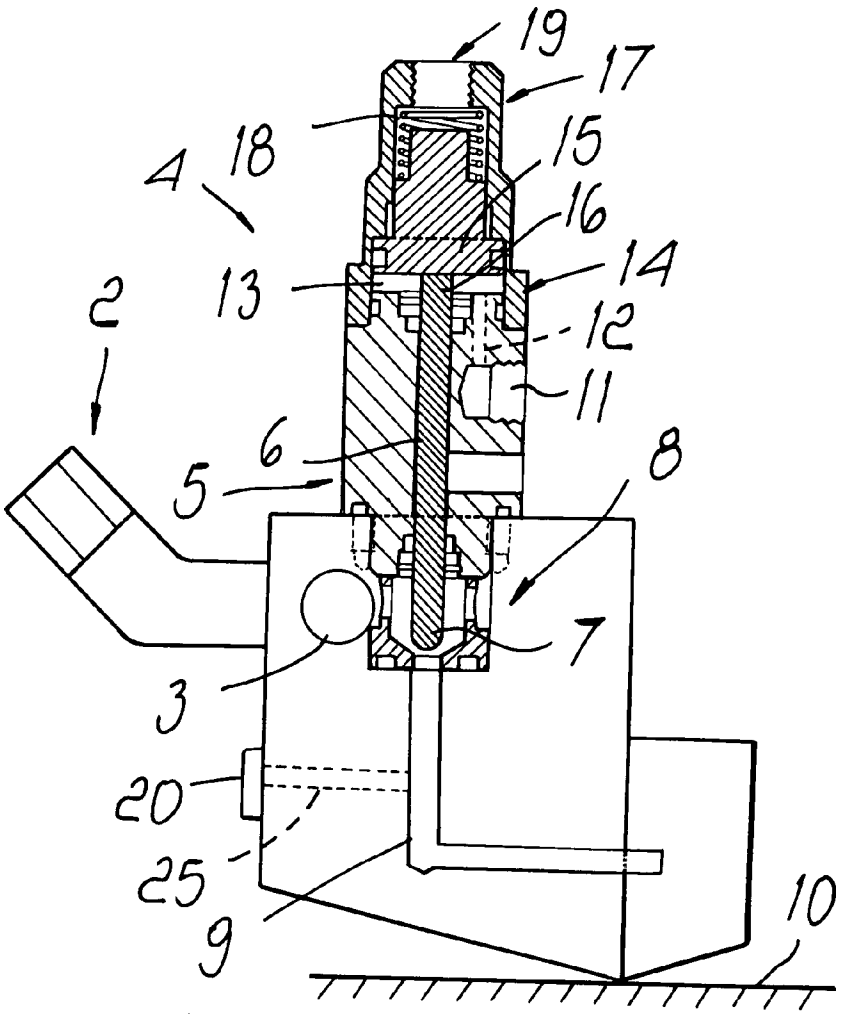
FIG. 2 is a partially sectional view, similar to FIG. 1.
Figure 1:
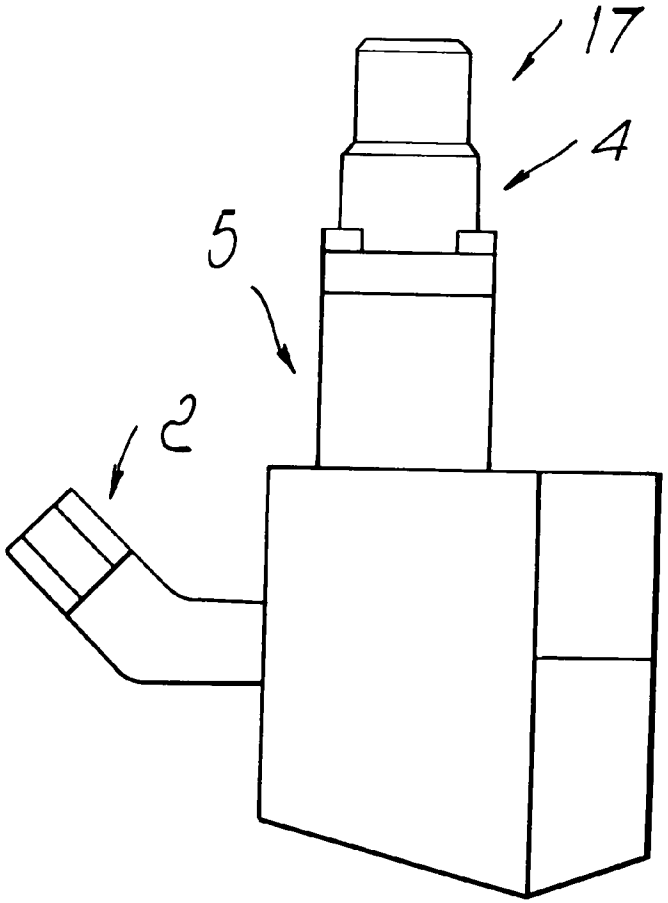
FIG. 1 is a side view of the spreading head according to the present invention.

With reference to the figures, the reference numeral 1 designates a spreading head particularly for spreading thermoplastic material on intermediate components.

The head 1 is preferably arranged transversely to the flow of motion of intermediate components on which for example an adhesive is to be applied, and has a first duct 2 for feeding the adhesive at a hole 3 for the transverse distribution of the adhesive at one or more valves 4.

Each one of the valves 4 comprises a body 5, rigidly coupled to the head 1, which contains a needle 6 arranged axially thereto; the tip 7 of the needle is arranged inside the head 1 at a cup 8, which is connected to a second duct 9 for spreading adhesive at a suitable substrate 10.

At the valve 4 there are means suitable to actuate the selective positioning of the needle 6 in an open position, such means being constituted for example by a first air intake 11 obtained laterally from the body 5 and connected to a third duct 12, which is in turn connected to a chamber 13 provided between a rear end 14 of the body 5 directed away from the cup 8 and a disk 15 to which a rear end 16 of the needle 6 is axially coupled, the disk sliding at a cover 17, which is associated with the rear end 14 of the body 5.

The disk 15, and therefore the needle 6, can move axially with respect to the body 5 and the cover 17 in contrast with at least one elastically deformable element, such as a spring 18.

The free end of the cover 17 advantageously has a second intake 19, which is preferably suitable to be connected to an air supply, like the first intake 11.

This solution allows to move the needle 6, for example by pneumatic actuation: it is possible to inject air at the first intake 11, so as to force the uncoupling of the tip 7 of the needle 6 from the cup 8, thus connecting the hole 3 to the second duct 9, so as to allow to spread the adhesive.

Any injection of air at the second intake 19 instead allows to achieve the movement of the needle 6 until it is arranged in the closed condition, in which its tip 7 closes the end of the second duct 9, so as to prevent the spreading of the adhesive.

As an alternative to the second intake 19, which can also be closed, the step for closing the needle 6 can be achieved by setting the spring 18 appropriately.

There is also a fifth intake 26, which is formed laterally to the body 5 at the chamber 13: at the fifth intake 26 it is possible to arrange an additional pressure sensor or a sensor for detecting the position of the disk 15 connected to the needle 6.

It is therefore again possible to control the position of the needle, as in the preceding cases.

It has thus been found that the invention has achieved the intended aim and objects, a head having been provided which allows to control the actual open condition of the valves, since it is possible to detect the position of the is needle.

It is thus possible to detect immediately any failure to apply adhesive along a band.

The invention is of course susceptible of numerous modifications and variations, all of which are within the scope of the same inventive concept.

Thus, for example, at the first intake 11 it is possible to connect an appropriate pressure sensor 20, which is suitable to confirm the position of the disk 15 and therefore of the needle 6, for example in the open condition in which the tip 7 of the needle does not close the second duct 9.

Figure 4:
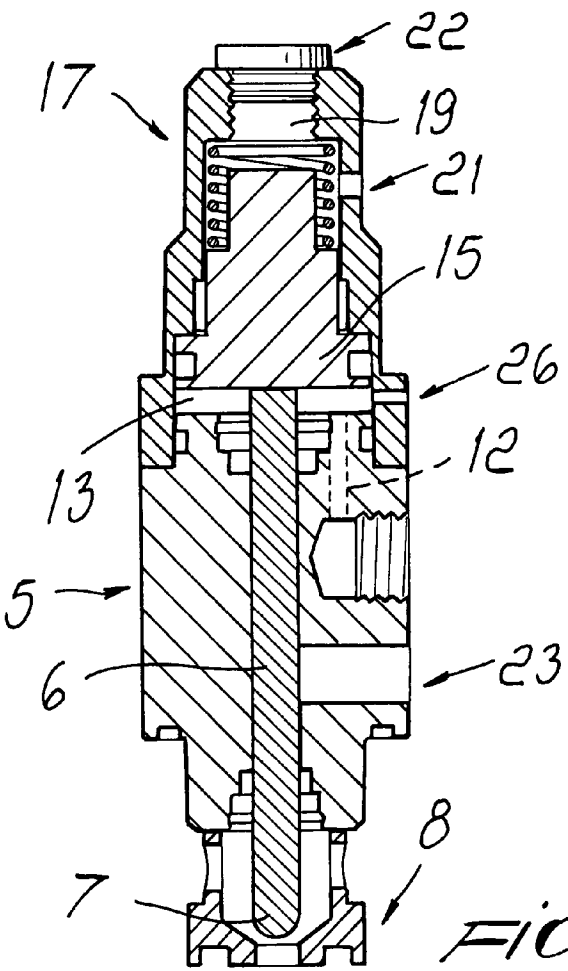
FIG. 4 is a view, similar to FIG. 3, of the valve.
Figure 3:
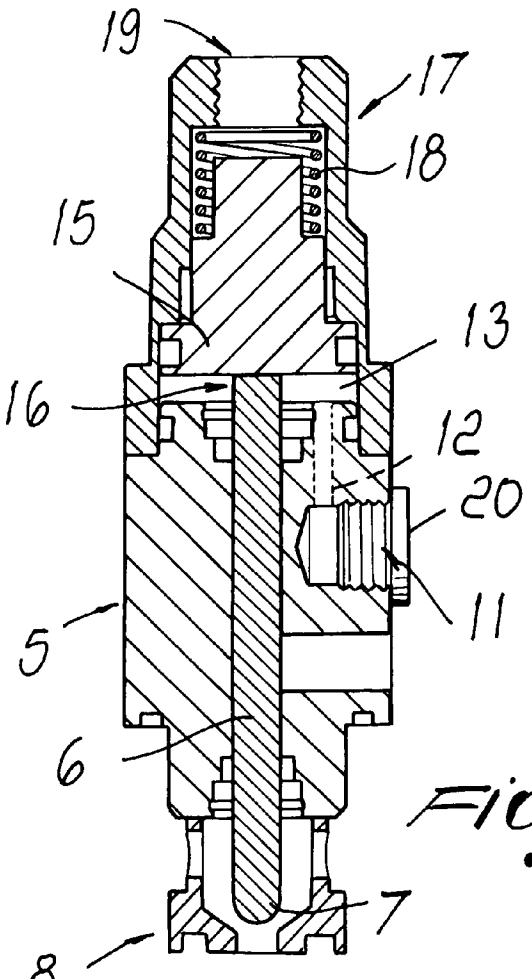
FIG. 3 is a sectional view of the valve.

As an alternative, as shown in FIG. 4, laterally to the cover 17 there is a third air intake 21, and at the same time the second intake 19 is closed by means of a capacitive sensor 22, suitable to provide a signal indicating the correct placement of the disk 15 and therefore of the needle 6.

The capacitive sensor 22 can be of the ON/OFF type if one wishes to detect exclusively the correct opening of the needle 6, or of the proportional type if one wishes to check, by means of the same instrument, also the correct closure of the needle 6.

In this case also, the spring 18 might be omitted.

As an alternative to the use of a capacitive sensor, it is possible to use a sensor of the magnetic type.

It is also possible to use a sensor suitable to check the position assumed by the needle 6 inside the body 5, for example a suitable optical sensor, which can be arranged at a fourth intake 23 formed radially with respect to the body 5 and adapted to connect an outer lateral surface 24 thereof with the seat in which the needle 6 slides.

In this case, the correct closed or open position of the needle 6 can be detected once again.

As an alternative, it is possible to install at the fourth intake 23 an electric position sensor, which can also be positioned, for example, at the second intake 19.

It is also possible to use a suitable pressure sensor located on the air circuit upstream of the first intake 11, the pressure sensor being suitable to confirm that the pressure that corresponds to a correct opening of the valve, and therefore to the lifting of the needle 7 with respect to the second duct 9, has been reached.

It is also possible to use a pressure sensor in the adhesive circuit located downstream of the valve 4 and therefore at the second duct 9; such duct can in fact be connected, by means of a suitable fourth duct 25, to the outside of the head 1; the fourth duct 25 is connected to a suitable pressure sensor 20 for hot-melt, which reports the correct opening of the valve because the pressure of the adhesive circuit downstream of said sensor has been reached.

Figure 6:
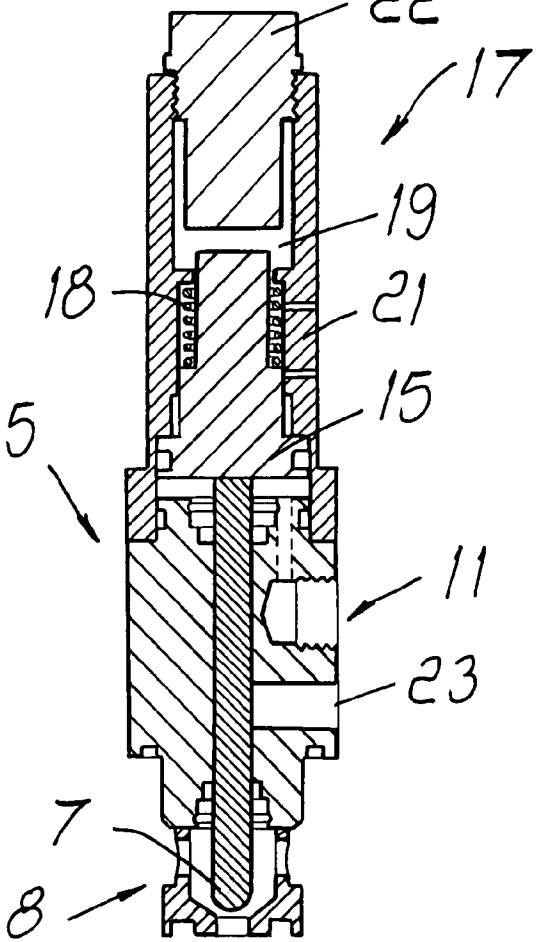
FIG. 6 is a view of the embodiment of FIG. 5, with the valve in the open condition.
Figure 5:
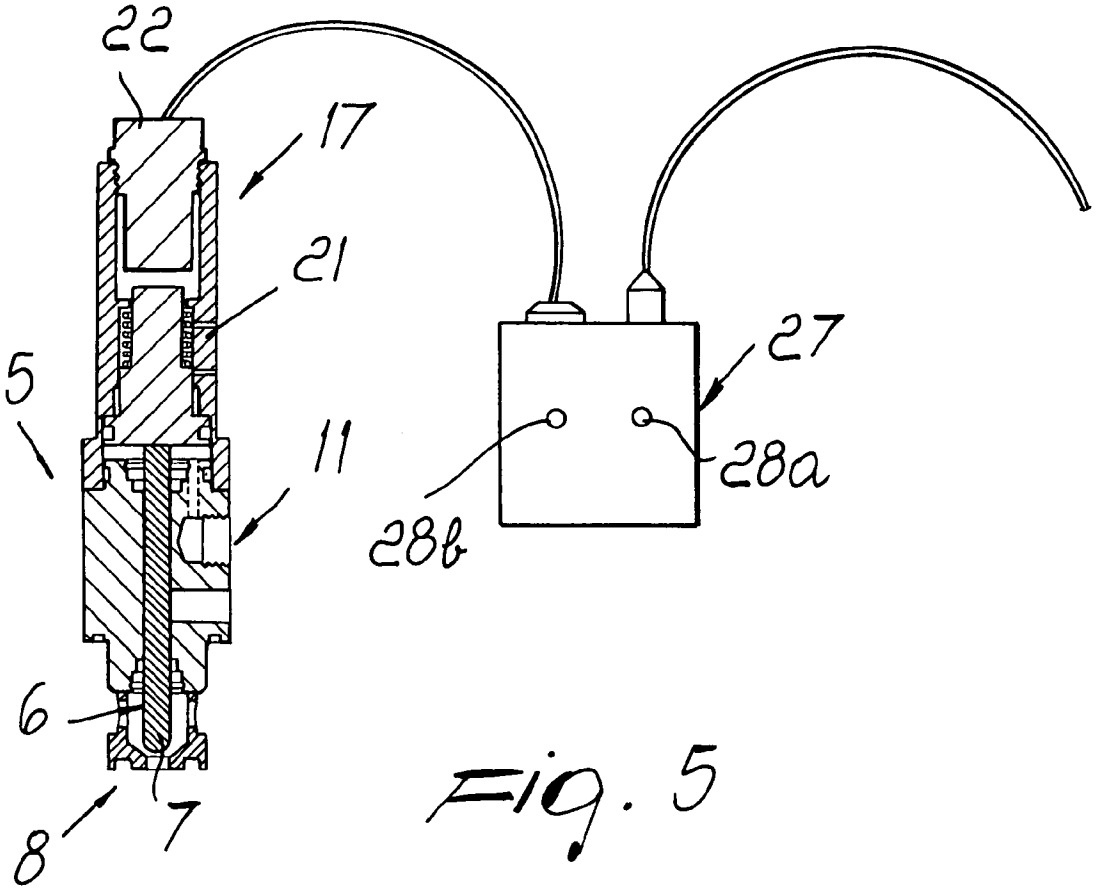
FIG. 5 is a view of the use of a capacitive sensor with the valve in the closed condition.

FIGS. 5 and 6 illustrate the use of a capacitive sensor 22 in combination with the third intake 21 for the inflow of, for example, air, so as to allow the axial closure movement of the needle 6.

In FIGS. 5 and 6, the cover 17 is elongated in order to allow to accommodate the capacitive sensor 22, which has a suitable axial length.

The capacitive sensor 22 can be used to check both the closed state and the open state (of the end of the second duct 9) of the needle 6; in the first case, the capacitive sensor 22 can therefore check the closure movement of the needle 6; advantageously, there is a suitable amplifier for the signal that arrives from the capacitor sensor 22 and there is a visual indicator 27, which comprises two LEDs 28*a* and 28*b* suitable, for example, to visually indicate the state of the position of the needle 6 and therefore the closure or not of the end of the second duct 9.

The materials used, as well as the dimensions of the individual components of the invention, may of course be more pertinent according to specific requirements.

The disclosures in Italian Patent Application No. TV2001A000008 from which this application claims priority are incorporated herein by reference.

What is claimed is:

1. A spreading head for spreading thermoplastic material on an intermediate component, comprising:

at least one valve having a body with a needle movable therein and a cup;

a first duct for feeding thermoplastic material in fluid state to said at least one valve;

a second duct, connected in fluid communication to said cup, for spreading said thermoplastic material on a substrate, said needle being movable in said body between an open position allowing passage of thermoplastic material flow from said first duct to said second duct, and a closed position in which the needle interferes with said cup to arrest the thermoplastic material flow; and actuation and detection means for actuating and detecting selective positioning of said needle, said actuation and detection means comprising a first intake for injection of a pressurized actuation fluid to form an actuation fluid circuit and adapted to move said needle at least to the open position and at least one sensor, said at least one sensor comprising a pressure sensor arranged either connected to said first intake, or on the actuation fluid circuit upstream of said first intake, so as to sense the pressure of the pressurized actuation fluid and provide a confirmation of the position of the needle at least in the open condition.

2. The head of claim 1, wherein said detection means further comprise a position detection sensor for detecting placement of said needle.

3. The head of claim 2, wherein said actuation means further comprises a second intake for injection of a pressurized actuation fluid adapted to move the needle to the closed position, said position detection sensor being provided at said second intake.

4. The head of claim 3, further comprising a hole, connected to said first duct, for transverse distribution of said thermoplastic material at said at least one valve, the body of said valve being rigidly coupled to said head, said needle being arranged axially in said body and having a tip arranged inside said head at said cup connected to said second duct, said first intake being provided laterally to said body; a chamber which is formed between a rear end of said body that is directed away from said cup; a third duct, connected to said first intake and to said chamber; and a disk to which a rear end of said needle is axially coupled; a cover that is associated with the rear end of said body, and said disk being slidable in said cover.

5. The head of claim 4, further comprising at least one elastically deformable element, said disk and said needle being movable axially with respect to said body and said cover in contrast with said at least one elastically deformable element.

6. The head of claim 5, wherein said second intake is provided at a free end of said cover, said first and second intakes being connected to a pressurized air supply for providing axial movement of said needle by pneumatic actuation.

7. The head of claim 6, wherein said needle has a tip, axial movement of said needle being actuated upon air injection at said first and second intakes for uncoupling said tip from said cup and, respectively, for making said tip close an end of said second duct.

8. The head of claim 6, wherein said elastically deformable element is set to allow closure of said needle on said cup once the injection of air at said second intake has ended.

9. The head of claim 4, further comprising a third air intake, provided laterally to said cover, said position detection sensor adapted to provide a signal indicating a position of said disk and therefore of said needle, and being located so as to close said second intake.

10. The head of claim 9, wherein said position detection sensor is a capacitive sensor.

11. The head of claim 9, wherein said position detection sensor is an optical sensor positioned at a fourth intake, formed radially to said body, which connects an outer lateral surface of said body to a seat provided inside said body, in which said needle slides.

12. The head of claim 11, further comprising an electric position sensor installed at one or more of said second and fourth intakes.

13. The head of claim 9, further comprising a fifth intake formed laterally to said body at said chamber, and an additional sensor arranged at said fifth intake for detecting the position of said disk.

14. The head of claim 4, further comprising a seat provided at said cover, a capacitive sensor arranged at said seat; a signal amplifier, and a visual indicator that comprises a pair of LEDs adapted to provide visual indication of the position of said needle and therefore on the closed or open state of said second duct, said capacitive sensor being wired to said signal amplifier.

15. The head of claim 1, further comprising a hot-melt pressure sensor arranged in a circuit of the thermoplastic material, which is arranged downstream of said valve, and a fourth duct being provided at the head to connect said second duct to an outside region of the head, said hot-melt pressure sensor being arranged at said fourth duct at said head region and at said second duct, to detect correct opening of said valve on reaching of a required pressure in the thermoplastic material circuit, downstream of said hot-melt pressure sensor.

16. The head of claim 1, for spreading adhesive in a fluid state on intermediate components, arranged transversally to a motion direction of the intermediate component.

* * * * *